US006079953A

United States Patent [19]

Morales

[11] Patent Number: 6,079,953

[45] Date of Patent: Jun. 27, 2000

[54] RAISING SIPHON METHOD AND APPARATUS

[75] Inventor: Fernando Morales, Reston, Va.

[73] Assignee: Interactive Return Service, Inc., Reston, Va.

[21] Appl. No.: 09/079,464

[22] Filed: May 15, 1998

[51] Int. Cl.[7] ..... F04B 19/24

[52] U.S. Cl. ..... 417/53; 417/52; 417/207

[58] Field of Search ..... 417/52, 53, 207

[56] References Cited

U.S. PATENT DOCUMENTS

| | | | |
|---|---|---|---|
| 1,472,428 | 10/1923 | Case et al. . | |
| 1,958,354 | 5/1934 | Stephens | 603/999 |
| 2,568,578 | 9/1951 | Bennett | 137/780 |
| 2,688,922 | 9/1954 | Bonaventura et al. | 417/52 |
| 2,841,323 | 7/1958 | Lindenblad | 417/52 |
| 3,071,154 | 1/1963 | Cargill et al. | 137/608 |
| 3,494,369 | 2/1970 | Inoue et al. | 137/13 |
| 3,687,291 | 8/1972 | Willinger | 210/169 |
| 3,701,357 | 10/1972 | Granström et al. | 137/81.5 |
| 3,776,439 | 12/1973 | Settle | 266/38 |
| 4,253,801 | 3/1981 | O'Hare | 417/52 |
| 4,258,700 | 3/1981 | Vaseen | 126/433 |
| 4,356,697 | 11/1982 | White | 60/682 |
| 4,366,857 | 1/1983 | Mayer | 165/104.23 |
| 4,416,587 | 11/1983 | Trihey | 417/52 |
| 4,583,918 | 4/1986 | Baumberg | 417/108 |
| 4,792,283 | 12/1988 | Okayasu | 417/52 |
| 5,129,788 | 7/1992 | Okayasu | 417/52 |

FOREIGN PATENT DOCUMENTS

| | | | |
|---|---|---|---|
| 251621 A1 | 11/1987 | Germany | G01N 17/26 |
| 61-245963 | 11/1986 | Japan | B22D 35/04 |
| 03102804 | 4/1991 | Japan | H01F 1/28 |
| 0534663 A2 | 3/1993 | Japan | F04F 1/02 |
| 06087062 | 3/1994 | Japan | B22D 17/30 |

*Primary Examiner*—Henry Bennett
*Assistant Examiner*—Mark Shulman
*Attorney, Agent, or Firm*—Roberts Abokhair & Mardula LLC

[57] ABSTRACT

A raising siphon for transferring fluids from a lower level to a higher level. The raising siphon works on the principal of increasing and/or decreasing the molecular size of fluids being transferred. Larger molecules are less dense than smaller molecules of the same type. Molecular manipulation occurs by the application of electrical current, magnetic flux and application of heat. When molecular expansion is applied to the intake column of fluid conduit, or siphon, a fluid flow from the intake column to the out take column is induced. Similarly when a molecular contraction force is applied to the out take column of a fluid conduit, a fluid flow is induce in the direction of the out take column. When the out take column outlet is at a higher level than the intake fluid level, an upward siphoning action is induced. Fluid flow therefore occurs in an upward direction.

22 Claims, 2 Drawing Sheets

RAISING SIPHON METHOD AND APPARATUS

FIELD OF INVENTION

This invention relates generally to siphon technology. More particularly this invention is a method and apparatus for siphoning fluid from a lower-level to a higher level through the application of heat, electrical current, and magnetic flux.

BACKGROUND OF THE INVENTION

Siphon technology has long been known to man. Typically a siphon takes water at one level, raises it over an obstacle of some type, and releases that water and a level lower than the first level relying upon gravity to move the water, or indeed any fluid. Siphon technology is used to drain flooded areas, empty swimming pools, and in other applications. The use of the heat, electrical current, and magnetic flux to move fluids is generally known. For example U.S. Pat. No. 5,515,679 to Shulman was granted for "Geothermal Heat Mining and Utilization." This patent recognizes that heated fluids are less dense and therefore flow upward where heat can be recovered. Once heat is recovered the cooled fluid is heavier and therefore sinks to lower levels to be recycled over a geothermal source. Thus water is rising from a lower-level to a higher level by Thermo-siphon circulation. This system is a closed loop system used principally to recover heat from the geothermal sources.

U.S. Pat. No. 4,346,731 to Sigworth was issued for a "buoyant element check valve for the Thermo siphon energy system." While this patent application deals with a particular mechanical element for a valve, it recognizes the thermo-siphon action that occurs in solar or energy systems and the fact that the heated liquid will travel upward until such time as it is cooled, whereupon it will travel in a downward motion. Thus by implication a siphon action could be created based upon heating a liquid.

U.S. Pat. No. 4,513,768 was issued to Sarver et al. for a "solar actuated drain system." The invention comprises a siphon having an inlet immerse in a pool water to be drained from a roof. A discharge end with a pressure responsive one-way valve is used to prevent the breaking of a siphon action. This invention is the classical case of a siphon being started to drain water from a high-level to a lower-level. In this invention heated water, based upon solar heating, causes the siphon action to begin. This again recognizes the fact that heated water can be used to create a siphon action.

U.S. Pat. No. 3,589,385 to Vitous was issued for a "vented hot water supply apparatus." This invention uses cold water in a closed tank to displace hot water from the tank through a siphon outlet. Again the concept of cold water being heavier and therefore displacing hot water in the top of the tank to create a siphon action is discussed. How the hot water is originally heated is not a discussion of this patent.

U.S. Pat. No. 2,568,578 to Bennett was issued for an "electrically heated transfer pipe." This patent relates specifically to transferring molten solids in an electrically heated pipe to keep molten solids in a fluid condition. In this invention, the problem of cooled molten metal is being addressed as is the flow of the molten metal. The flow is enhanced by electrically heating the pipe in which the mall metal is flowing. It does not address electrically heating or charging the fluid itself and therefore affecting the molecular structure of the fluid.

U.S. Pat. No. 3,420,411 to Ronchese was issued for a "dispenser for quantities of hot water." Again a siphon action is used for the dispensing of heated water. However the energy source is not discussed nor is the key concept of changing the fluid characteristics to begin a siphon action addressed.

Other Patents have dealt with and discussed the issues of forces acting on fluids. For example U.S. Pat. No. 3,701,357 to Granstrom et al. shows the use of magnetic force affecting a fluid flow. U.S. Pat. No. 3,071,154 to Cargill et al. shows electrically charged fluids. U.S. Pat. No. 3,494,3692 to Inoue shows fluid flow control by magnetic, electrostatic, or current flow means. However, none of these patents deal with generally raising water level specifically through heated or other means to begin a siphoning action, particularly in an upward direction.

It would therefore be useful to have an energy efficient means for moving water from a lower-level to an upper level without the use of substantial amounts of energy to do so. This will allow the siphoning action to take place which can move water upward as well as to begin the siphoning action in the more classical sense where water is moved over an obstacle to downward direction. In either case such action can give rise to power supplies and the generation of electrical and mechanical power in a very cost-effective way.

SUMMARY OF THE INVENTION

Is therefore objective of the present invention to create a raising siphon using principles of molecular expansion and contraction of fluids.

It is a further objective of the present invention to use a raising siphon to create mechanical energy to be used for other purposes.

It is a further objective of the present invention to raise a fluid from a lower-level to a higher level by creating the temperature differential between the intake in the output of a siphon tube.

It is a further objective of the present invention to raise a fluid from a lower-level to a higher level by the application of magnetic flux.

It is a further objective of the present invention to raise a fluid from a lower-level to a higher level by the application of electrical current.

These and other objectives of the present invention will become apparent to those skilled in the art by the review of the specification that follows. The present invention comprises a raising siphon. As noted earlier, siphons are well-known for moving a fluid from one level to a lower-level, when an obstacle of some type must be overcome. In the present invention, the raising siphon uses electrical, magnetic, or thermal energy alone or in combination to raise fluid from a lower-level to a higher level.

The raising siphon powered by temperature differential moves a fluid from a lower-level (the intake level) is to a higher level (the output level). This is accomplished by the siphon of the present invention maintaining the temperature differential between the intake column and the output column. It is well known that heated water flows to the surface of a volume of water since the expansion of water molecules makes each molecule less dense than a colder version of the same molecule. More expansion of individual molecules takes place as temperature increases. If the temperature differential is increased by applying more heat to an intake column, the height of the water in the intake column will rise producing a higher output level.

In the out take column, heat is dissipated form the fluid by fin cooling of the out take column or other ways known in the art to dissipate heat quickly from a fluid. The siphon of the present invention will balance the weight of the intake column with the weight of the output column. Because the output column will need less height to balance the weight, the output level will be at higher level than the intake level. Thus the flow of a fluid will proceed from a lower-level to a higher level so long as the temperature differential is applied.

In the present invention it has been found that a one percent expansion of the molecular volume can be accomplished with the few degrees of temperature differential. In such a case, if the intake column height is 10 meters, the difference in the output level will be 10 cm for only a few degrees of temperature differential. Thus the modest application of heat to the intake column can cause a continuous pumping action whereby a fluid is raised from a lower-level to a higher level.

An alternative embodiment of the present invention involves used of magnetic flux to raise the fluid level in an intake column to a higher level, the output level. This is accomplished by maintaining a magnetic flux on the intake column. When magnetic flux travels inside a molecular structure, such as a fluid, this magnetic flux affects the forces that keep the molecular elements together thus causing molecular expansion. With molecular expansion, molecules that are so expanded are less dense than molecules to which magnetic flux has not been applied. If an increase in the magnetic flux to intake column also fluid is applied, the expansion of the molecules will increase as well. This in turn will increase the height of the intake column to accommodate to molecular expansion of the molecules to which the magnetic flux is applied.

Again the siphon action of the present invention will balance the weight of the intake column with a weight of the output column. Because the output column will need less height to balance the weight, the output level will be at higher level than the intake level. This molecular expansion will continue so long as the magnetic flux is applied and, it has been found, for some time thereafter.

It has been found that a one percent molecular expansion can be achieved with the modest magnetic flux generated by ½ amp current on 1,000 feet of wire in a three quarter in. coil over a pipe. Therefore, again, if the intake column height is 10 meters, the difference in the output level of the output type will be 10 cm. Increasing the magnetic flux will accelerate the molecular expansion and hence increase the molecular movement. This action intern will generate a siphoning action raising the fluid from a lower-level to a higher level.

In yet another alternative embodiment of the present invention the raising siphon can raising fluid from an intake level to a higher output level if an electric current is maintained, in this case, on the output column. It is well-known that salt water will allow electric current to flow through it and that the flow of electricity will force a molecular contraction to occur in order to allow the electrons to move freely. Molecules that are contracted, that is, occupy less space, are more dense making them heavier than other molecules which are not subject to molecular contraction. To a certain extent, more contraction of molecules can be obtained by increasing the electrical current applied to the molecules. In this instance when electrical current is applied to an output column, the fluid in the output column becomes heavier thereby requiring less column of the fluid, since such fluid will be heavier, then the column height required in the intake column. Balancing the output column with the input column results in the output, level being at higher level than the input column level. This process will continue so long as the electrical current is applied to the output column fluid. In this fashion an upward siphoning action can be maintained by the continual application of electrical current to the fluid in an output column.

As an example, a one percent molecular contraction can be achieved with each 0.2 amp of current. This represents a very modest amount of electrical current. If the intake column height is 10 meters, the difference in output level will be 10 cm for each 0.2 amp of current.

The present invention can further be understood by reference to the following figures.

LIST OF FIGURES

DETAILED DESCRIPTION OF THE INVENTION

Figure 1:
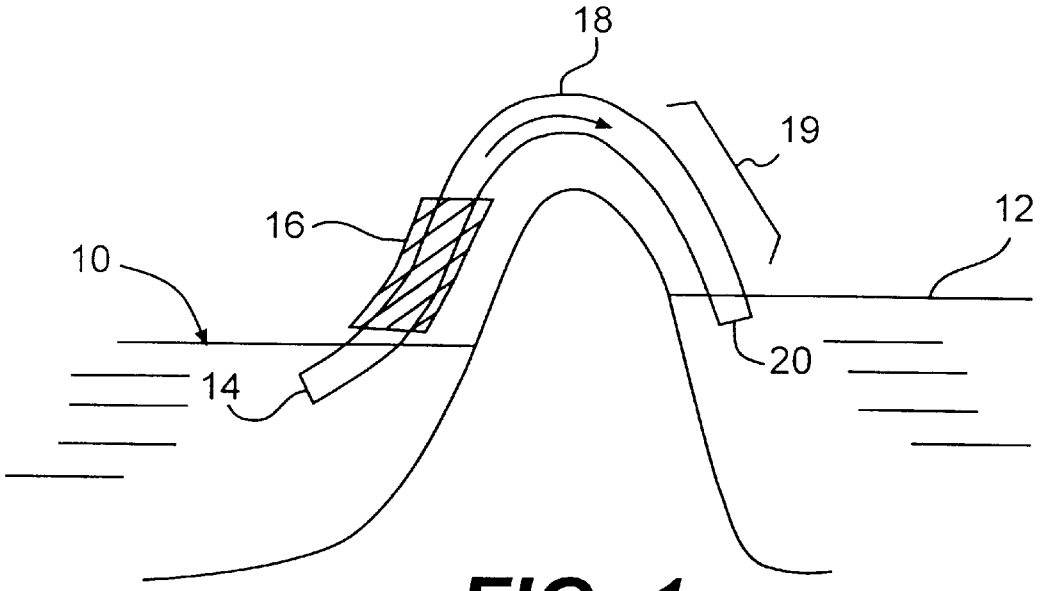
FIG. 1 shows a raising siphon by the application of heat.

Referring to FIG. 1 a raising siphon by the application of heat is shown. A siphon tube, also referred to herein and in the appended claims as a fluid conduit, 18 is immersed in a fluid at a first level 10. Intake opening 14 is immersed in the fluid at the first level 10. Heat is applied in to the intake column in a particular zone 16 of the siphon tube 18. This causes the fluid in the intake column to expand thereby becoming lighter. The fluid in column 19 is cooler than the fluid in the column 16. This output column 19 is therefore heavier and therefore less fluid is required in this column to counter the weight in the intake column 16. Less fluid is expelled from the out put column at the out take opening 20. Thus fluid at level 10 is moved to fluid at a higher level 12 by virtue of the application of heat to the intake column at 16.

Figure 2:
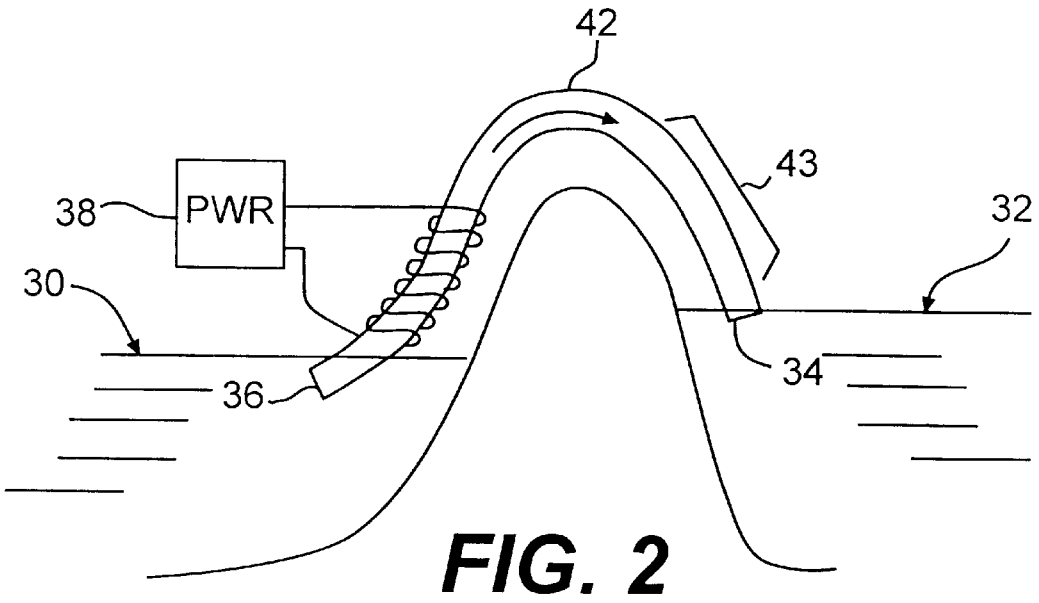
FIG. 2 shows a raising siphon by the application of magnetic flux.

Referring to FIG. 2 the raising siphon by the application of magnetic flux is shown. In this case, fluid at level 30 is to be moved to fluid at a higher level 32. Intake opening 36 is immersed in the fluid at the lower-level 30 and the out take column opening 34 is at a level higher than lever 30. In this case this out take opining is shown as being immersed in a fluid where the fluid level is at a higher level than level 32. This should not be construed however as a limitation. Fluid that is to be moved in siphon tube 42 is first subject to a magnetic flux caused by current passing through coil 40 which is wrapped around the intake column. In an alternative embodiment, the magnetic flux can be provided by permanent magnets arrayed around the intake column. Power supply 38 provides the necessary current to the coil 40. By virtue of the application of magnetic flux to the coil 40 molecular expansion occurs causing the fluid to move through the siphon to 42 in the direction of the arrow. Thereafter, out take column 43 in which the magnetic flux is discharged, has molecules which again are more dense then in the intake column. This results in a column height which is less, resulting in out take level 32 being at a higher level than intake level 30. In this fashion and upward siphoning action occurs whereby fluid at lower-level 30 is moved to higher level 32.

Figure 3:
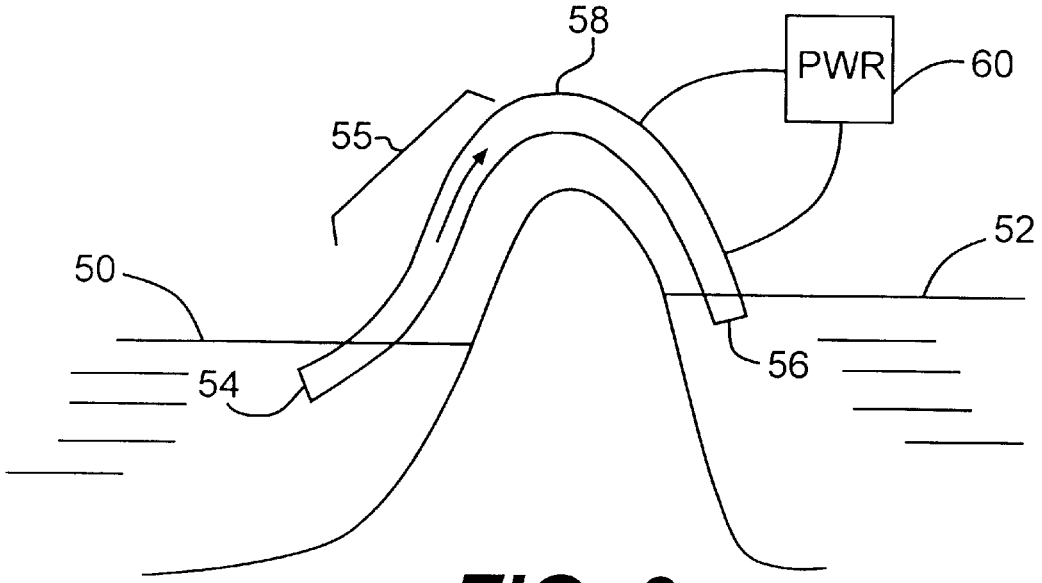
FIG. 3 shows a raising siphon by the application electrical current.

Referring to FIG. 3 the raising siphon by application of electrical current is shown. In this instance, fluid at level 50 is to be moved to fluid at level 52. In this instance power supply 60 provides power to the output a column. This results in molecules of the fluid being compressed and therefore more dense. Thus the out take column for the same weight of fluid is again shorter. Since the fluid in intake column 55 is less dense, it requires a larger column of fluid for the same amount fluid weight. Thus fluid is taken in an intake 54, moved through intake column 55, through the siphon to out take 56. Molecular contraction occurs in the out take column when power from power supply 60 is applied to the out take column. In this fashion an upwards siphoning action occurs whereby fluid at level 50 is moved to a higher level at fluid level 52.

This siphoning action occurs in a highly energy-efficient fashion. Thus not only can a fluid be moved to in upward direction, but the fluid can be used to mechanically power, for example, a turbine that can produce electricity. Once fluid is at a higher level, normal siphoning forces can be used to move at fluid to a lower-level thereby producing a great more electrical current than used to produce the upward siphoning action in the first instance.

A raising siphon were has now been described. It will be appreciated by those skilled in the art that this raising siphon action can be used to not only to move fluid from one level to another but to provide power and mechanical energy for other purposes as well. It is therefore considered within the scope of the present invention to apply these methods of upward siphoning of fluids in a variety of situations such as electrical generation, applications of mechanical energy, manufacturing, refrigeration and other applications where the mechanical energy from the fluid flow can be converted for other purposes.

I claim:

1. A raising siphon for any fluid, comprising:

a fluid conduit having an intake opening, an intake column, and out take column and an out take opening;

a molecular expansion force applied directly to the fluid in the intake column for expanding molecules of the fluid;

wherein the intake opening of the fluid conduit is immersed in a source of the fluid at a first level, and wherein the out take opening is at a second level higher than the first level; and wherein the molecular expansion force induces a continuous fluid flow from the first level to the second level.

2. The raising siphon of claim 1 wherein the molecular expansion force consists of a magnetic field.

3. The raising siphon of claim 2 wherein the magnetic field is produced by an electromagnet.

4. The raising siphon of claim 2 wherein the magnetic field is produced by a permanent magnet.

5. The raising siphon of claim 1 wherein the molecular expansion force is heat.

6. The raising siphon of claim 5 further comprising a heat dissipater connected to the out take column for dissipating heat from the fluid.

7. A raising siphon for any fluid, comprising:

a fluid conduit having an intake opening, an intake column, and out take column and an out take opening;

a molecular contraction force applied directly to the fluid in the out take column for contracting molecules of the fluid;

wherein the intake opening of the fluid conduit is immersed in a source of the fluid at a first level, and wherein the out take opening is at a second level higher than the first level; and and wherein the molecular contraction force induces a continuous fluid flow from the first level to the second level.

8. The raising siphon of claim of claim 7 wherein the molecular contraction force consists of an electric current.

9. A method of raising any fluid from a first level to a second higher level by siphon action, comprising:

applying a molecular expansion force directly to the fluid in an intake column of a fluid conduit wherein the fluid conduit further comprising an intake opening immersed in a source of the fluid at a first level, an out take column, and an out take opening, the out take opening at a second higher level; and wherein the molecular expansion force induces a continuous fluid flow from the first level to the second level.

10. The method of raising a fluid from a first level to a second higher level of claim 9 wherein the molecular expansion force consists of a magnetic field.

11. The method of raising a fluid from a first level to a second higher level of claim 9 wherein the magnetic field is produced by an electromagnet.

12. The method of raising a fluid from a first level to a second higher level of claim 9 wherein the magnetic field is produced by a permanent magnet.

13. The method of raising a fluid from a first level to a second higher level of claim 9 wherein the molecular expansion force is heat.

14. The method of raising a fluid from a first level to a second higher level of claim 13 further comprising a dissipating the heat from the fluid by a heat dissipater connected to the out take column.

15. A method of raising any fluid from a first level to a second higher level by siphon action, comprising:

applying a molecular contraction force directly to the fluid in an out take column of a fluid conduit wherein the fluid conduit further comprises an intake opening immersed in a fluid at a first level, an intake column, and an out take opening, the out take opening being at a second higher level; and wherein the molecular contraction force induces a continuous fluid flow from the first level to the second level.

16. The method of raising a fluid from a first level to a second higher level of claim 15 wherein the molecular contraction force consists of an electric current applied to the fluid flowing through the out take column.

17. The raising siphon of claim 1, wherein the molecular expansion force is a low energy source applied at a steady rate.

18. The raising siphon of claim 7, wherein the molecular contraction force is a source of low current applied at a steady rate.

19. A raising siphon for any fluid, comprising:

a fluid conduit having an intake opening, an intake column, and out take column and an out take opening;

a molecular expansion force applied to the fluid in the intake column for expanding molecules of the fluid;

wherein the intake opening of the fluid conduit is immersed in a source of the fluid at a first level;

wherein the out take opening is at a second level higher than the first level;

wherein the molecular expansion force induces a fluid flow from the first level to the second level; and wherein the molecular expansion force consists of a magnetic field.

20. A method of raising any fluid from a first level to a second higher level by siphon action, comprising:

applying a molecular expansion force to the fluid in an intake column of a fluid conduit wherein the fluid conduit further comprising an intake opening immersed in a source of the fluid at a first level, an out take column, and an out take opening, the out take opening at a second higher level; and wherein the molecular expansion force induces a fluid flow from the first level to the second level; and wherein the molecular expansion force consists of a magnetic field.

21. A raising siphon for any fluid, comprising:

a fluid conduit having an intake opening, an intake column, and out take column and an out take opening;

a molecular expansion force applied directly to the fluid in the intake column for expanding molecules of the fluid;

wherein the intake opening of the fluid conduit is immersed in a source of the fluid at a first level, and wherein the out take opening is at a second level higher than the first level; and wherein the molecular expansion force induces a fluid flow from the first level to the second level without requiring a phase-change of the fluid.

22. A method of raising any fluid from a first level to a second higher level by siphon action, comprising:

applying a molecular expansion force directly to the fluid in an intake column of a fluid conduit wherein the fluid conduit further comprising an intake opening immersed in a source of the fluid at a first level, an out take column, and an out take opening, the out take opening at a second higher level; and wherein the molecular expansion force induces a fluid flow from the first level to the second level without requiring a phase-change of the fluid.

* * * * *